US006318683B1

(12) United States Patent
Savoy

(10) Patent No.: US 6,318,683 B1
(45) Date of Patent: Nov. 20, 2001

(54) INFANT UTENSIL HAVING TWIST LOCK COUPLING

(76) Inventor: Adonica B. Savoy, 910 Oak Creek Estates Dr., Lewisville, TX (US) 75067

( * ) Notice: Subject to any disclaimer, the term of this patent is extended or adjusted under 35 U.S.C. 154(b) by 0 days.

(21) Appl. No.: 09/434,294

(22) Filed: Nov. 5, 1999

(51) Int. Cl.[7] ..... A47G 23/02; B25G 3/00

(52) U.S. Cl. ..... 248/146; 403/348

(58) Field of Search ..... 248/146, 154, 248/127, 467, 343, 205.5, 205.6, 311.2; 403/348, 349

(56) References Cited

U.S. PATENT DOCUMENTS

| | | | | |
|---|---|---|---|---|
| 3,989,152 | | 11/1976 | Julian . | |
| 4,345,691 | | 8/1982 | Burke . | |
| 4,416,438 | | 11/1983 | King . | |
| 4,619,549 | * | 10/1986 | Gilbreth | 403/349 |
| 4,754,383 | * | 6/1988 | Klaus | 248/343 |
| 4,832,218 | | 5/1989 | Gibilisco . | |
| 4,869,381 | | 9/1989 | Agner . | |
| 4,893,978 | | 1/1990 | Frano . | |
| 4,998,632 | | 3/1991 | Morris, Sr. . | |
| 5,082,220 | | 1/1992 | Pollock et al. . | |
| 5,161,706 | | 11/1992 | Weinstein . | |
| 5,524,530 | * | 6/1996 | Nijzingh et al. | 99/492 |
| 5,699,438 | * | 12/1997 | Smith et al. | 403/348 |
| 5,725,114 | | 3/1998 | Pickman . | |
| 5,765,604 | * | 6/1998 | Garvey, III | 248/206.3 |
| 5,855,451 | * | 1/1999 | Milton et al. | 403/348 |
| 5,940,350 | * | 8/1999 | Booty, Jr. | 248/206.2 |
| 6,000,575 | * | 12/1999 | LaCour et al. | 248/311.2 |

* cited by examiner

*Primary Examiner*—Ramon O. Ramirez
*Assistant Examiner*—Jerome A. DeLuca
(74) *Attorney, Agent, or Firm*—Parkhurst & Wendel, L.L.P.

(57) ABSTRACT

This invention relates to an infant utensil apparatus. The apparatus comprises a utensil, such as a feeding bowl, which is connected to a base through a twist lock coupling. The base can include a suction cup which can be removably attached to a conforming surface such as a table. The utensil has legs extending downward from the utensil in a circular pattern and such legs are adapted to provide a first part of the twist lock coupling. The base for the apparatus is adapted to provide the second part of the twist lock coupling which together with the first part of the twist lock coupling holds the utensil firmly to the base. The base can also be included in the feeding table of a high chair as an integral part of the feeding table.

32 Claims, 5 Drawing Sheets

INFANT UTENSIL HAVING TWIST LOCK COUPLING

FIELD OF THE INVENTION

This invention relates to an infant utensil, such as an infant feeding bowl, which is attached to a base, such as a feeding table, through a twist lock coupling.

BACKGROUND OF INVENTION

When infants and small children are fed in a high chair, they often have a tendency to play with their food, throw the utensils for serving the food to get attention of parents or care providers, or accidentally drop or move the feeding utensils. Several approaches have been suggested to avoid the problems associated with feeding infants and small children.

Restraining devices have been proposed in U.S. Pat. Nos. 4,416,438 and 5,082,220 to prevent bottles from being accidentally thrown on the floor. A tubular friction connection to attach a bottle to a feeding table has been suggested in U.S. Pat. No. 4,869,381 to provide a bottle with increased stability that is less likely to be knocked over. However, a bottle attached to a feeding table through a tubular friction connection can be easily separated from the table by a simple motion of pulling on the bottle.

Twist lock bottle caps are well known in the art for making child resistant bottle caps for pharmaceuticals and hazardous materials. See for example, U.S. Pat. Nos. 4,345,691; 3,989,152; 4,832,218; and 5,725,114 and the patents referenced in these patents. Twist lock fasteners are also known in the art as shown by U.S. Pat. No. 4,893,978.

Feeding bowls having an integral suction cup on the bottom of the bowl are also know in the art to keep infants from throwing the bowl. However, the suction cup has to be removed from the table for cleaning of the bowl and the suction cups are not readily usable with other utensils. In addition, the suction cups are readily degraded and lose suction when the bowl is washed in a dishwasher under high heat conditions.

SUMMARY OF INVENTION

In accordance with the present invention an improved infant utensil apparatus is provided which secures the utensil to a base in a manner so the infant cannot easily detach it from the base, but it can be easily removed by an adult for cleaning and replenishing the food. The utensil is connected to the base through a twist lock coupling which makes it difficult for the infant to remove the utensil from the base. In preferred embodiments a first part of the twist lock coupling is located in the bottom of the utensil and a cooperative part of the twist lock necessary to complete the coupling is located in a base element which can be a high chair feeding table, a base having a suction cup which can be attached to a conforming surface and the like. The utensil can be a feeding bowl, a nursing bottle, a cup with a straw, a feeding plate or a toy.

DESCRIPTION OF THE PREFERRED EMBODIMENTS

The utensils of this invention have a bottom which is adapted to provide the first part of a twist lock coupling. The bottom can be legs extending downward from the remainder of the utensil in a substantially circular pattern. Generally two or more legs are provided which contain the first part of the interlock coupling. In preferred embodiments the legs extending downward are sufficiently wide or sufficient in number to provide an even support for the utensil when it is placed on a surface without the base. In the embodiment shown in FIG. 1 the legs providing the first part of the interlock structure extend down and are connected to make a complete circular structure. In another embodiment the utensil has two arc shaped legs located on opposite sides of the circular pattern each of which extends for a quarter of the circular pattern to provide legs over half of the bottom of the circular pattern. In another embodiment the utensil has four legs positioned at the quarter points of the circular pattern.

Generally, as many legs can be used as desired and the legs are generally of uniform length to support the utensil in an upright position. However, in embodiments where it is desired to cant the upper part of the utensil in angular relationship to the infant, such as a bottle or drinking cup some of the legs can be made longer to provide the canted position. In the canted embodiments the legs are preferably constructed to also support the utensil without the base structure.

Preferably one part of the structure for the twist lock coupling is located on the legs of the utensil and the other cooperative part is located on the base structure.

Figure 1:
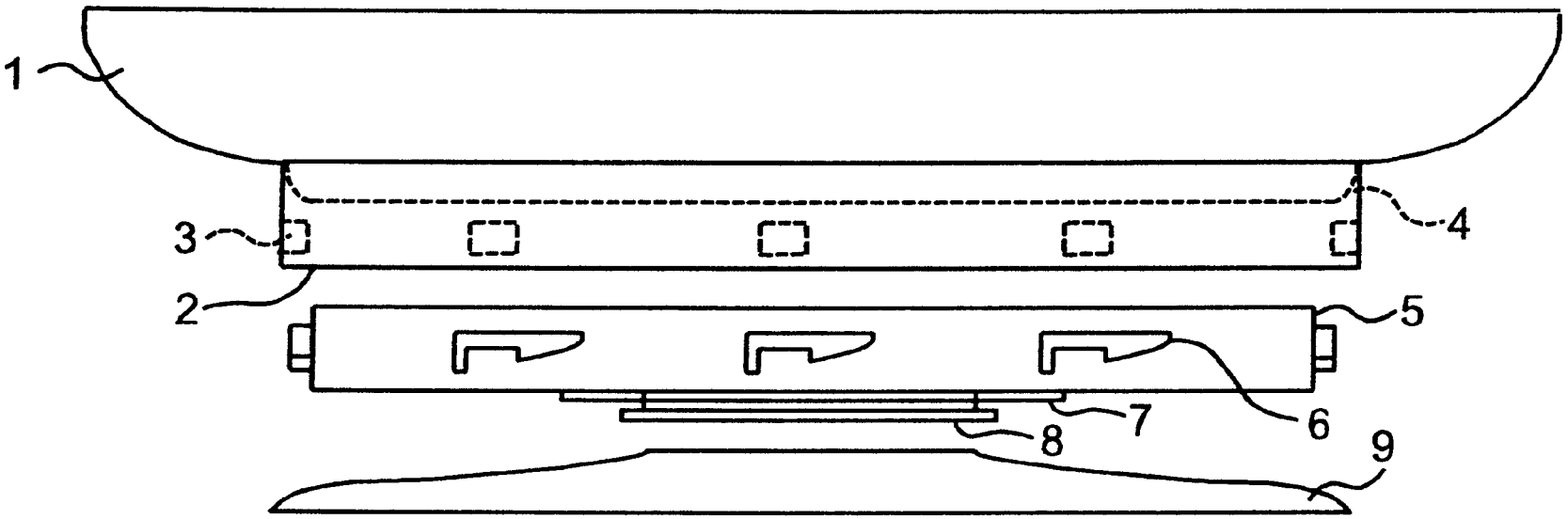
FIG. 1 is a view of the component parts of an infant utensil, a base and the suction cup of the base.
Figure 1A:
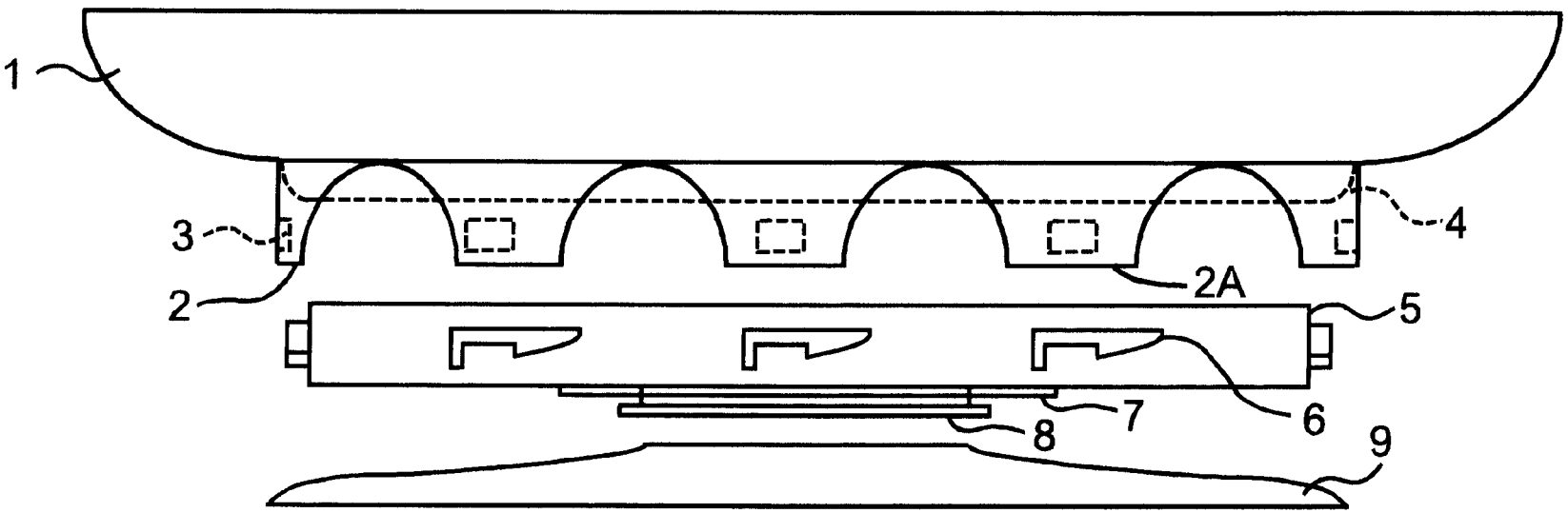
FIG. 1A is a view of the component parts of an infant utensil having multiple legs extending downward, a base and the suction cup of the base.
Figure 2:
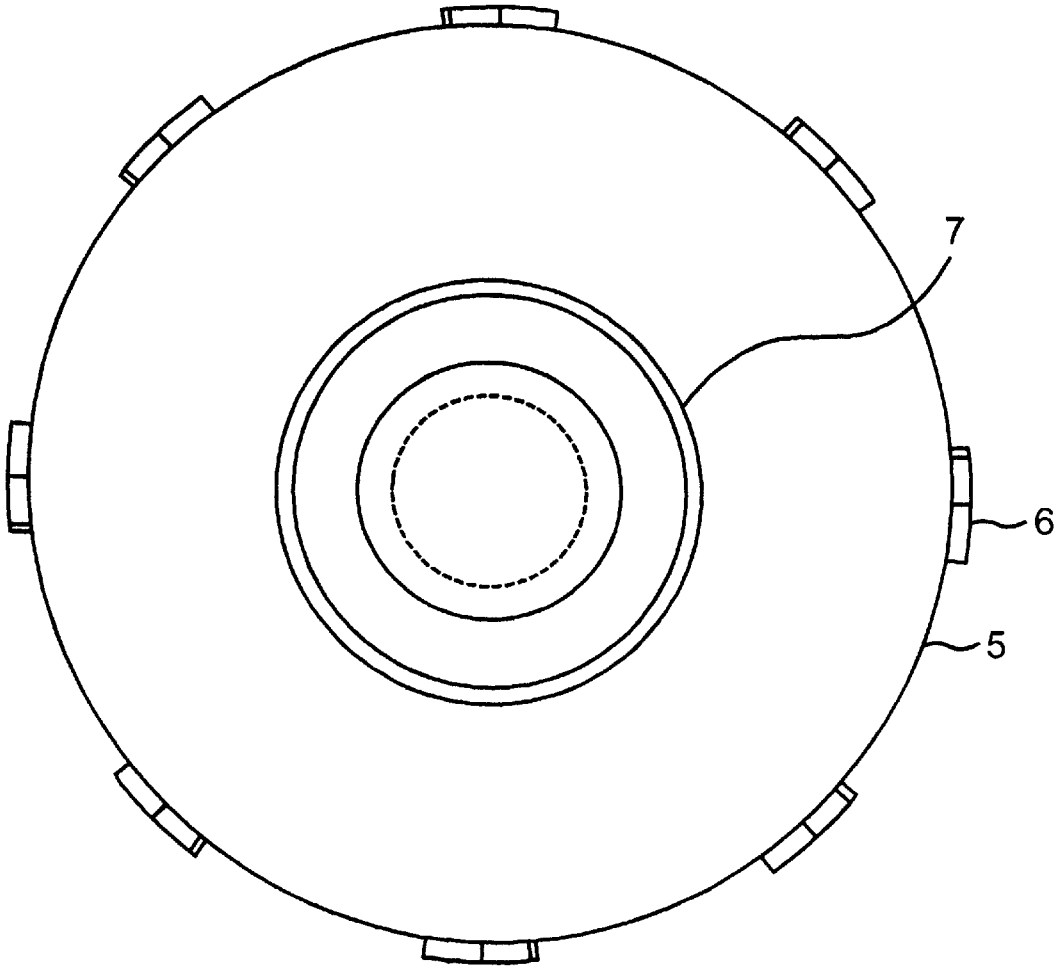
FIG. 2 is a bottom view of the base shown in FIG. 1 with the suction cup removed.

One embodiment of the invention is shown in FIGS. 1 and 2. The utensil is a feeding bowl 1 having a bottom wall 2 extending downwardly in a circular pattern from the bowl. The bottom 2 contains projections 3 spaced around the inner side of the bottom wall. A resilient spring type element 4 is inside the inner wall 2. A base element 5 is circular in shape and contains snap lock projections 6 spaced around the outer wall of the element 5. The top of element 5 can be open or it can be provided with a top portion extending across the element. The bottom of base element 5 is provided with a circular structure 7 having a lip 8 for engaging and locking into suction cup 9. In use the suction cup and the base element can be mounted on a table and various utensils can be placed on the base and locked in place. When the infant is finished eating, the utensil can be easily removed from the base for cleaning and, if desired, another utensil, such as a toy, can be positioned on the base to occupy the attention of the infant.

In preferred embodiments the twist lock structure is a push-twist lock structure. This structure has a resilient spring type member located in either the base or utensil portion to hold the projections in a groove or recess of the cooperative portion of the twist lock. The resilient elements useful in accordance with this invention are capable of exerting a biasing force between two elements. They are elastic elements capable of storing energy when compressed and recover their basic form when the compressive forces are released. In order to disconnect the push-twist lock coupling a pushing force against the resilient member is required in addition to a turning force. The term push-twist lock as used herein refers to a twist lock that requires a pushing force as well as a turning force to disconnect the coupling. A push-twist lock can be made shown in FIGS. 1 and 2 where projections 3 are located in the utensil portion and snap lock elements are located in the base. A resilient member 4 is shown which holds the projections 3 firmly in the recesses of projections 6.

The snap lock projections 6 shown in FIG. 1 can be mounted on the base element along the entire length of the projection. They can also be mounted at only the left end where the right end is not attached and the end of projection 6 is sufficiently resilient to spring upward when the projection 3 is twisted into locking position.

The respective cooperative component parts of the twist lock couplings and the push-twist lock couplings can be located in either the upper utensil part or the lower base part as long as the necessary alignment and positioning of the lock components is maintained to achieve a firm lock.

The resilient spring type elements can be molded into the base or utensil parts of the apparatus or the can be attached by adhesives, or welding techniques used for attachment of the respective materials. A springlike resilient element is preferably molded into the bottom to the utensil at the time the utensil is molded. The incorporation of the resilient element in the utensil as part of the molding process is easier when there are open spaces between the legs of the utensil. The materials selected for feeding utensils are those known in the art to be acceptable for food uses and generally include various food approved polymeric materials.

Figure 3:
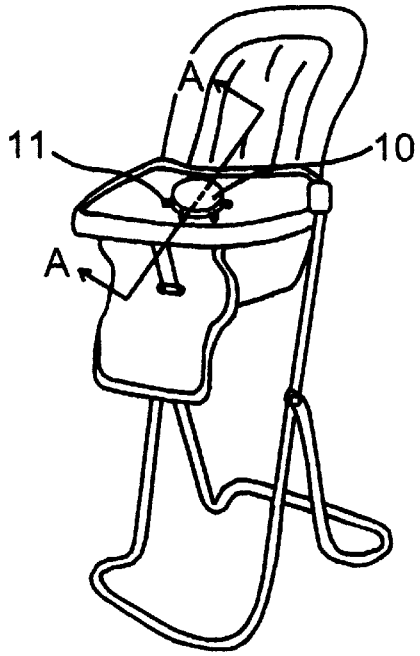
FIG. 3 is a view of a high chair with the base and the bottom portion of the twist lock coupling incorporated into the feeding table.
Figure 4:
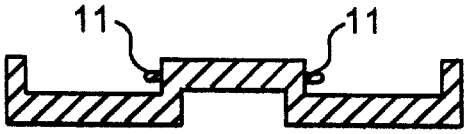
FIG. 4 is a cross sectional view of the feeding table shown in FIG. 3 at the mid section of the base at Section A—A of FIG. 3 containing the twist lock coupling.

An embodiment of the invention where a base, without a suction cup, is affixed to or molded into the feeding table of a high chair is shown in FIG. 3. The table contains a substantially cylindrical portion 10 extending upwardly from the table. A sectional view of the tray with the cylindrical portion extending upwardly is shown in FIG. 4. Twist lock projections are located around the outer wall of the upwardly extending cylinder which projections together with the projections in the utensil form the twist lock coupling. The utensil can be easily placed on the feeding table and locked in place. A feeding table according to this embodiment preferably has the base element for the twist lock coupling molded into the table resulting in an integral one piece table. The one piece table is easier to clean than tables where the cylindrical base is attached to a separate table.

Figure 5:
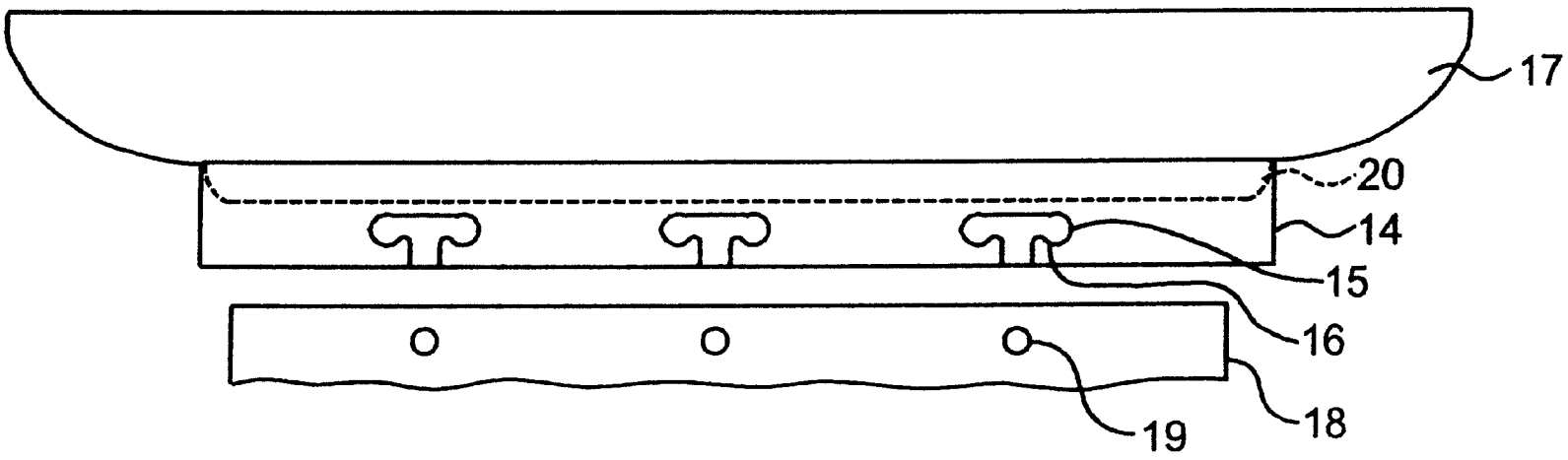
FIG. 5 is a view of the component parts of a utensil, base and twist lock coupling which is used with the feeding table shown in cross section in FIG. 4.

FIG. 5 shows an embodiment of a utensil which works well with the high chair shown in FIGS. 3 and 4. In this embodiment the utensil 17 has a circular base 14 having slot type openings 15 located around the wall to engage the projections 19 in base 18. The projections 19 fit snugly into the openings 15 and slide past the knob 16 to seat in the far end of the slot. In this embodiment the downwardly extending legs or wall 14 can be sized in the circular pattern to closely fit around the element 18. A resilient member 20 can also be used to more firmly lock the utensil in place in the event the knobs are not sufficiently large to lock the utensil in place. The projections 19 can also provide sufficient resilience to spring upward past the knobs 16 and then spring back to their normal position when past the knob 16 to hold the utensil in locking engagement with the base.

Figure 6:
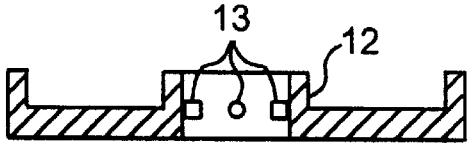
FIG. 6 is a cross sectional view of an alternate feeding table (not shown) at the mid section of the base containing the twist lock coupling.

Another embodiment of a high chair having the base element molded into the feeding table is shown only in cross sectional view in FIG. 6. The cylindrical base element has an open top for insertion of the bottom part of the utensil. Projections 13 are located on the inner walls of the cylinder to engage the twist lock elements of the utensil to lock the utensil in place. In this embodiment the cylinder 12 is preferably molded into the feeding table to provide an integral one piece element. The twist lock structure of the utensil of FIG. 5 can be easily modified to make it compatible with the base structure depicted in FIG. 6 where the element 14 would be sized to fit inside the cylinder 12. Resilient elements can be molded into the bottom of the utensil at the top of element 14. A spring like element having one end connected to the utensil bottom with a free end slanted downward will engage and be biased against the upper surface of cylinder 12 to provide a compression locking force. Thus, the utensil can be locked in the openings 15 behind knob 16. In this embodiment the walls of the cylinder are generally made thick enough so that they do not provide edges which could injure the infant when the utensil is not in place. A locking cover is also generally provided to cover the opening when the utensil has been removed.

In another embodiment the twist lock coupling is a child resistant twist lock coupling. Child resistant twist lock couplings are well known in the art can be substituted for the twist lock couplings shown above where it is desired to provide a coupling between the utensil and the base which has a higher resistance to removal of the utensil.

While I have illustrated and described my invention by means of specific embodiments, it is understood that changes and modifications of the various elements may be made without departing from the spirit and scope of the invention as defined in the appended claims.

I claim:

1. An infant utensil apparatus comprising:

an infant feeding dish or infant toy having legs extending downward in a substantially circular pattern and which provide a first part of a push-twist lock coupling, and a base for supporting said utensil having a top and which provide a second part of a push-twist lock coupling, which together with said first part of said push-twist lock coupling holds said utensil securely to said base, and a resilient element located in said utensil or said base adapted to exert a biasing force downward to hold the first part of said push-twist lock coupling in locking engagement with the second part of said push-twist lock coupling.

2. An infant utensil apparatus according to claim 1, wherein said legs extend downward in a continuous circular pattern to provide the first part of the said twist lock coupling.

3. An infant utensil apparatus according to claim 1, wherein said infant utensil is a feeding bowl having legs of uniform length adapted to support said feeding bowl in an upright position when placed on a flat surface without said base.

4. An infant utensil apparatus according to claim 1, wherein said base includes on the bottom thereof, a suction cup for detachable attachment to a flat surface.

5. An infant utensil apparatus according to claim 1, wherein said utensil is a food plate.

6. An infant utensil apparatus according to claim 1, wherein said second part of said push-twist lock coupling contains a recess for engaging said first part of said push-twist lock coupling.

7. An infant utensil according to claim 1, wherein said first part of said push-twist lock coupling contains a resilient element for exerting a biasing force downward to hold the first part of said push-twist lock coupling in locking engagement with said second part of said twist lock coupling.

8. An infant utensil apparatus comprising:

an infant feeding dish or infant toy having legs extending downward in a substantially circular pattern and which provide a first part of a push-twist lock coupling, and a base for supporting said utensil having a top and which provide a second part of a push-twist lock coupling, which together with said first part of said push-twist lock coupling holds said utensil securely to said base, a resilient element located in said utensil or said base adapted to exert a biasing force downward to hold the first part of said push-twist lock coupling in locking engagement with the second part of said push-twist lock coupling, and wherein said base is a feeding table and said second part of said push-twist lock coupling is part of said feeding table and said legs of said infant utensil have slots therein which cooperate with projections on said base to provide said push-twist lock coupling.

9. An infant utensil apparatus comprising:

an infant feeding dish or infant toy having legs extending downward in a substantially circular pattern and which provide a first part of a push-twist lock coupling, and a base for supporting said utensil having a top which provides a second part of a push-twist lock coupling, which together with said first part of said push-twist lock coupling holds said utensil securely to said base, a resilient element located in said utensil or said base adapted to exert a biasing force downward to hold the first part of said push-twist lock coupling in locking engagement with the second part of said push-twist lock coupling, and wherein said base is a feeding table and said second part of said push-twist lock coupling are an integral part of said feeding table.

10. An infant utensil apparatus comprising:

an infant feeding dish or infant toy having a bottom which provides a first part of a push-twist lock coupling, a base, for supporting said utensil, having a top which provides a second part of a twist lock coupling, which together with said first part of said push-twist lock coupling secures the utensil firmly to said base, a resilient element located in said utensil or said base adapted to exert a biasing force downward to hold the first part of said push-twist lock coupling in locking engagement with the second part of said push-twist lock coupling, and the bottom part of said base containing a suction cup for detachable attachment to a conforming surface.

11. An infant utensil apparatus according to claim 10, wherein said infant utensil is a feeding bowl having legs of uniform length adapted to support said feeding bowl in an upright position when placed on a flat surface without said base.

12. An infant utensil apparatus according to claim 10, wherein said utensil contains a resilient element which exerts a spring force for biasing the first part of said twist lock coupling against the second part of said twist lock coupling when the coupling is in the locked position.

13. An infant utensil apparatus according to claim 10, wherein said utensil is an infant feeding dish.

14. An infant utensil apparatus according to claim 10, wherein said suction cup is adapted for detachable attachment to a flat table.

15. An infant utensil apparatus according to claim 10, wherein said first part of said push-twist lock coupling contain a recess for engaging said second part of said twist lock coupling.

16. An infant utensil apparatus according to claim 10, wherein said utensil has at least two legs extending downward in a circular pattern with projections on at least two of said legs to provide one part of said push-twist lock coupling.

17. An infant utensil apparatus according to claim 10, wherein said base includes projections thereon for providing the second part of said push-twist lock coupling.

18. An infant utensil according to claim 10, wherein said infant utensil has at least two legs which extend in total at least half way around said circular pattern and said legs have projections thereon to provide said push-twist lock coupling.

19. An infant high chair having a feeding table and having an infant utensil attached to said feeding table through a push-twist lock connection comprising:

an infant utensil having legs extending downward in a substantially circular pattern which are adapted to provide a first part of said push-twist lock coupling, a portion of said feeding table adapted to provide a second part of said push-twist lock coupling, which together with the first part of said twist lock coupling firmly attaches the utensil to the feeding table, and a resilient element located in said utensil or said table adapted to exert a biasing force downward to hold the first part of said push-twist lock coupling in locking engagement with the second part of said push-twist lock coupling.

20. An infant high chair according to claim 19, wherein said feeding table contains a cylindrical element extending upwardly from said feeding table with projections extending outwardly which form the second part of said push-twist lock coupling.

21. An infant high chair according to claim 19, wherein said feeding table contains a circular tubular opening in said feeding table with projections extending inwardly to form the second part of the push-twist lock coupling.

22. An infant high chair according to claim 19, wherein said utensil is an infant feeding bowl.

23. An infant high chair according to claim 19, wherein said utensil includes a compression element as part of the twist lock coupling to hold the first and second parts of the push-twist lock coupling in locked position.

24. An infant high chair according to claim 19, wherein said feeding table has a circular opening having the second part of the push-twist lock located therein and said table also comprises a locking cover adapted to cover said circular opening when the utensil is not in place.

25. An infant high chair according to claim 19, wherein the legs of said infant utensil contain at least two slots which cooperate with projections on said base to provide a push-twist lock coupling.

26. An infant high chair according to claim 19, wherein said infant utensil has legs extending downward in a substantially circular pattern and extending around substantially the entire circle and projections are molded on said legs to provide one part of push-twist lock coupling, and said feeding table contains an integral cylindrical element containing projections on the walls of said cylindrical element which cooperate with the projections on the legs of said infant utensil to provide said push-twist lock coupling and at least one resilient element is located on the infant utensil to bias the infant utensil against the cylindrical element during coupling.

27. An infant feeding dish having legs extended downward in a substantially circular pattern which legs are of uniform length adapted to support said feeding utensil in an upright position when placed on a flat surface and which legs provide part of a push-twist lock coupling and include projections having a recess or a slot having a recess which projections or slots adapted to cooperate with projections on a base to complete a push-twist lock coupling, and a resilient element located in said utensil adapted to exert a biasing force downward to hold the first part of said push-twist lock coupling in locking engagement with the second part of said push-twist lock coupling, and a base for supporting said utensil having a top which provides a second part of a twist lock coupling, which together with said first part of said twist lock coupling holds said utensil securely to said base, and wherein said base includes on the bottom thereof, a suction cup for detachable attachment to a flat surface.

28. An infant high chair having a feeding table wherein said feeding table contains a substantially cylindrical element in said table with projections extending from said cylinder which are adapted to cooperate with projections or slots on the bottom of an infant utensil to complete a push-twist lock coupling.

29. An infant high chair according to claim 28, wherein the cylinder is integral with said feeding table and extends upwards from said feeding table and said projections on said cylinder extend outwardly from said cylinder.

30. An infant high chair according to claim 28, wherein the cylinder is integral with said feeding table and said projections on said cylinder extend inwardly from said cylinder.

31. An infant utensil apparatus comprising:

an infant feeding utensil having legs of substantially uniform length extending downward in a substantially circular pattern adapted to support said feeding utensil in an upright position and which are adapted to provide a first part of a twist lock coupling, and a base for supporting said utensil having a top which is adapted to provide a second part of a twist lock coupling, which together with said first part of said twist lock coupling holds said utensil securely to said base, and wherein said base includes on the bottom thereof, a suction cup for detachable attachment to a flat surface.

32. An infant utensil apparatus comprising:

an infant feeding utensil having legs of substantially uniform length extending downward in a substantially circular pattern adapted to support said feeding utensil in an upright position and which are adapted to provide a first part of a twist lock coupling, and a base for supporting said utensil having a top which is adapted to provide a second part of a twist lock coupling, which together with said first part of said twist lock coupling holds said utensil securely to said base, and wherein said base is a feeding table and said second part of said twist lock coupling is part of said feeding table.

* * * * *